US011112730B2

(12) United States Patent
Yamada et al.

(10) Patent No.: US 11,112,730 B2
(45) Date of Patent: Sep. 7, 2021

(54) DEVELOPING DEVICE ALLOWING SELECTION OF A STIRRING/CONVEYING MEMBER TO BE USED FROM A PLURALITY OF TYPES OF STIRRING/CONVEYING MEMBERS WITH ROTARY SHAFTS WITH DIFFERENT SHAFT-DIAMETERS AND IMAGE FORMING APPARATUS THEREWITH

(71) Applicant: KYOCERA Document Solutions Inc., Osaka (JP)

(72) Inventors: Ryo Yamada, Osaka (JP); Yuji Kamiyama, Osaka (JP); Yu Sasaki, Osaka (JP); Ikuo Makie, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/031,152

(22) Filed: Sep. 24, 2020

(65) Prior Publication Data

US 2021/0109459 A1 Apr. 15, 2021

(30) Foreign Application Priority Data

Oct. 15, 2019 (JP) ..... JP2019-188563

(51) Int. Cl.
*G03G 15/08* (2006.01)

(52) U.S. Cl.
CPC ..... *G03G 15/0891* (2013.01); *G03G 15/0865* (2013.01); *G03G 15/0889* (2013.01); *G03G 15/0893* (2013.01); *G03G 2215/0607* (2013.01); *G03G 2215/0636* (2013.01); *G03G 2215/083* (2013.01); *G03G 2215/0838* (2013.01)

(58) Field of Classification Search
CPC ..... G03G 15/0891; G03G 15/0889; G03G 15/0865; G03G 2215/0636; G03G 2215/0607; G03G 15/0893; G03G 2215/083; G03G 2215/0838; G03G 15/0894
See application file for complete search history.

(56) References Cited

U.S. PATENT DOCUMENTS

| | | | | |
|---|---|---|---|---|
| 3,664,299 A * | 5/1972 | Shaler | G03G 15/09 | 399/256 |
| 2006/0115302 A1 | 6/2006 | Hosokawa et al. | | 399/254 |
| 2010/0014895 A1 | 1/2010 | Hosokawa et al. | | 399/258 |

(Continued)

FOREIGN PATENT DOCUMENTS

JP 2006-178405 A 7/2006

*Primary Examiner* — Walter L Lindsay, Jr.
*Assistant Examiner* — Laura Roth
(74) *Attorney, Agent, or Firm* — Stein IP, LLC

(57) ABSTRACT

A developing device includes a developer container, a developer carrier, and a stirring/conveying member. The developer container stores developer containing toner. The developer carrier carries on its surface the toner in the developer container. The stirring/conveying member includes a rotary shaft rotatably supported on the developer container and a stirring blade formed around the outer circumferential face of the rotary shaft and stirs and conveys the developer in the developer container. The stirring/conveying member to be used can be selected from a plurality of types of stirring/conveying members with rotary shafts with different shaft diameters.

22 Claims, 10 Drawing Sheets

(56) References Cited

U.S. PATENT DOCUMENTS

| | | | | |
|---|---|---|---|---|
| 2011/0243612 | A1 | 10/2011 | Hosokawa et al. | 399/252 |
| 2014/0270818 | A1* | 9/2014 | Tanaka | G03G 15/0879 399/27 |
| 2014/0314451 | A1 | 10/2014 | Hosokawa et al. | 399/254 |
| 2016/0026116 | A1 | 1/2016 | Hosokawa et al. | |
| 2016/0306296 | A1 | 10/2016 | Hosokawa et al. | |
| 2018/0011425 | A1* | 1/2018 | Sasaki | G03G 15/0893 |

* cited by examiner

DEVELOPING DEVICE ALLOWING SELECTION OF A STIRRING/CONVEYING MEMBER TO BE USED FROM A PLURALITY OF TYPES OF STIRRING/CONVEYING MEMBERS WITH ROTARY SHAFTS WITH DIFFERENT SHAFT-DIAMETERS AND IMAGE FORMING APPARATUS THEREWITH

INCORPORATION BY REFERENCE

This application is based on and claims the benefit of Japanese Patent Application No. 2019-188563 filed on Oct. 15, 2019, the contents of which are hereby incorporated by reference.

BACKGROUND

The present disclosure relates to developing devices which are mounted in image forming apparatuses based on electrophotography such as copiers, printers, facsimile machines, and multifunction peripherals incorporating the functions of more than one of those and which include a stirring/conveying member for conveying developer while stirring it. The present disclosure also relates to image forming apparatuses incorporating such a developing device.

In image forming apparatuses, a latent image formed on an image carrier, typically a photosensitive member, is developed by a developing device and is visualized as a toner image. The developing device stores developer containing toner in a developer container, includes a developing roller for supplying the developer to the image carrier, and includes a stirring/conveying member which supplies, while conveying and stirring, the developer in the developer container to the developing roller.

For example, in a known developing device including two developer stirring/conveying members and two developer storing portions, the volume of the first developer stirring/conveying member which stirs and conveys the developer in the first developer storing portion is made larger than the volume of the second developer stirring/conveying member which stirs and conveys the developer in the second developer storing portion so that the volume of the developer in the first developer accommodating portion, which feeds the developer to a developer carrier, is larger than the volume of the developer in the second developer storing portion, which is fed with toner from above.

SUMMARY

According to one aspect of the present disclosure, a developing device includes a developer container, a developer carrier, and a stirring/conveying member. The developer container stores developer containing toner. The developer carrier carries on its surface the toner in the developer container. The stirring/conveying member includes a rotary shaft rotatably supported on the developer container and a stirring blade formed around the outer circumferential face of the rotary shaft and stirs and conveys the developer in the developer container. The stirring/conveying member to be used can be selected from a plurality of types of stirring/conveying members with rotary shafts with different shaft diameters.

This and other objects of the present disclosure, and the specific benefits obtained according to the present disclosure, will become apparent from the description of embodiments which follows.

DETAILED DESCRIPTION

Figure 1:
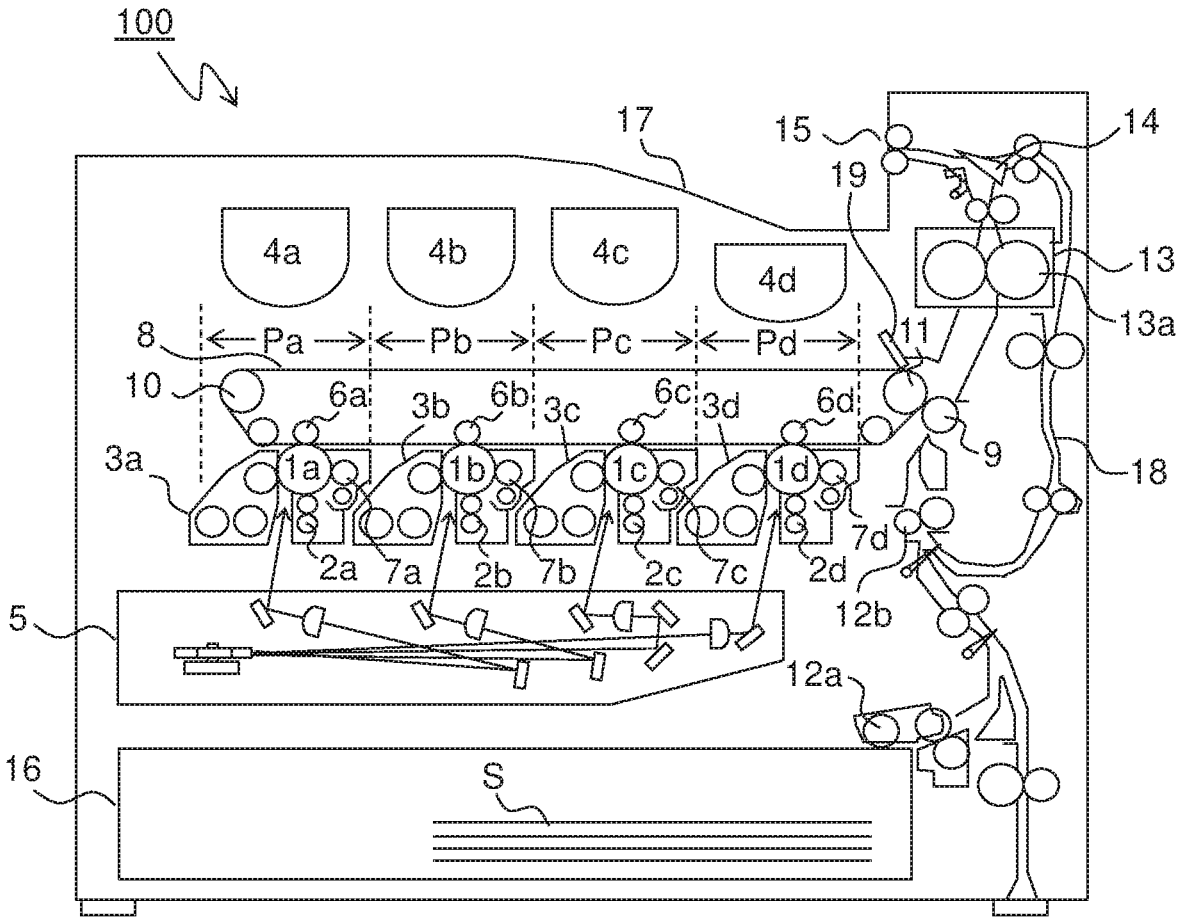
FIG. 1 is a schematic sectional view of an image forming apparatus mounted with a developing device according to one embodiment of the present disclosure.

Hereinafter, with reference to the accompanying drawings, embodiments of the present disclosure will be described. FIG. 1 is a sectional view showing an internal structure of an image forming apparatus 100 mounted with developing devices 3*a* to 3*d* according to one embodiment of the present disclosure. In the main body of the image forming apparatus 100 (here, a color printer), four image forming portions Pa, Pb, Pc and Pd are arranged in this order from upstream in the conveying direction (from the left side in FIG. 1). These image forming portions Pa to Pd are provided so as to correspond to images of four different colors (cyan, magenta, yellow, and black) and sequentially form images of cyan, magenta, yellow, and black through the processes of electrostatic charging, exposure, developing, and transfer.

In these image forming portions Pa to Pd, photosensitive drums (image carriers) 1*a*, 1*b*, 1*c*, and 1*d* are respectively arranged which carry visible images (toner images) of the different colors. Further, an intermediate transfer belt 8 which rotates counter-clockwise in FIG. 1 is provided adjacent to the image forming portions Pa to Pd. The toner images formed on the photosensitive drums 1*a* to 1*d* are primarily transferred sequentially, while being superimposed on each other, to the intermediate transfer belt 8 that moves while keeping contact with the photosensitive drums 1*a* to 1*d*. Then, the toner images primarily transferred to the intermediate transfer belt 8 are secondarily transferred by a secondary transfer roller 9 to transfer paper S, which is one example of a recording medium. The transfer paper S on which the toner images have been secondarily transferred is, after having the toner images fixed on it in a fixing portion 13, discharged out of the main body of the image forming apparatus 100. An image forming process is performed with respect to the photosensitive drums 1*a* to 1*d* while they are rotated by a main motor 40 (see FIG. 4) clockwise in FIG. 1.

The transfer paper S to which toner images are to be secondarily transferred is stored in a sheet cassette 16 arranged in a lower part of the main body of the image forming apparatus 100. The transfer paper S is conveyed via a sheet feeding roller 12*a* and a registration roller pair 12*b* to a nip portion between the secondary transfer roller 9 and a driving roller 11 of the intermediate transfer belt 8. Used as the intermediate transfer belt 8 is a sheet of dielectric resin, and typically is a belt without seams (seamless belt). On the downstream side of the secondary transfer roller 9, a blade-form belt cleaner 19 is arranged for removing toner and the like left on the surface of the intermediate transfer belt 8.

Next, the image forming portions Pa to Pd will be described. Around and below the photosensitive drums 1*a* to 1*d* that are rotatably arranged, there are provided charging devices 2*a*, 2*b*, 2*c*, and 2*d* which electrostatically charge the photosensitive drums 1*a* to 1*d* respectively, an exposure device 5 which exposes the photosensitive drums 1*a* to 1*d* to light carrying image information, developing devices 3*a*, 3*b*, 3*c*, and 3*d* which form toner images on the photosensitive drums 1*a* to 1*d* respectively, and cleaning devices 7*a*, 7*b*, 7*c*, and 7*d* which remove developer (toner) and the like left on the photosensitive drums 1*a* to 1*d* respectively.

When image data is input from a host device such as a personal computer, first, the surfaces of the photosensitive drums 1*a* to 1*d* are electrostatically charged uniformly by the charging devices 2*a* to 2*d*. Next, the exposure device 5 irradiates the photosensitive drums 1*a* to 1*d* with light based on the image data to form on them electrostatic latent images reflecting the image data. The developing devices 3*a* to 3*d* are loaded with predetermined amounts of two-component developer containing cyan, magenta, yellow, and black toner respectively. When, through formation of toner images, which will be described later, the proportion of toner in the two-component developer stored in the developing devices 3*a* to 3*d* falls below a determined value, toner is supplied from toner containers 4*a* to 4*d* to the developing devices 3*a* to 3*d* respectively. The toner in the developer is fed from the developing devices 3*a* to 3*d* to the photosensitive drums 1*a* to 1*d* respectively, and electrostatically attaches to them. In this way, toner images corresponding to the electrostatic latent images formed through exposure to light from the exposure device 5 are formed.

Then, by primary transfer rollers 6*a* to 6*d*, electric fields with a predetermined transfer voltage are applied between the primary transfer rollers 6*a* to 6*d* and the photosensitive drums 1*a* to 1*d*, and the cyan, magenta, yellow, and black toner images on the photosensitive drums 1*a* to 1*d* are primarily transferred to the intermediate transfer belt 8. These images in four colors are formed with a predetermined positional relationship with each other that is prescribed for formation of a predetermined full-color image. Then, in preparation for the subsequent formation of new electrostatic latent images, toner and the like left on the surface of the photosensitive drums 1*a* to 1*d* after the primary transfer are removed by the cleaning devices 7*a* to 7*d*.

The intermediate transfer belt 8 is stretched around a driven roller 10 on the upstream side and the driving roller 11 on the downstream side, and as the driving roller 11 is driven to rotate by a belt driving motor (unillustrated), the intermediate transfer belt 8 starts to rotate counter-clockwise. Then, the transfer paper S is conveyed with predetermined timing from the registration roller pair 12*b* to a nip portion (secondary transfer nip portion) between the driving roller 11 and the secondary transfer roller 9 arranged adjacent to it, and the full-color image on the intermediate transfer belt 8 is secondarily transferred to the transfer paper S. The transfer paper S on which toner images have been secondarily transferred is conveyed to the fixing portion 13.

The transfer paper S conveyed to the fixing portion 13 is heated and pressed by a fixing roller pair 13*a*, and thereby the toner images are fixed on the surface of the transfer paper S to form a predetermined full-color image. The transfer paper S on which the full-color image has been formed has its conveying direction switched by a branch portion 14 which is branched into a plurality of directions, and is then directly (or after being directed to a duplex printing conveying passage 18 to have images formed on both its faces) discharged to a discharge tray 17 by a discharge roller pair 15.

Figure 2:
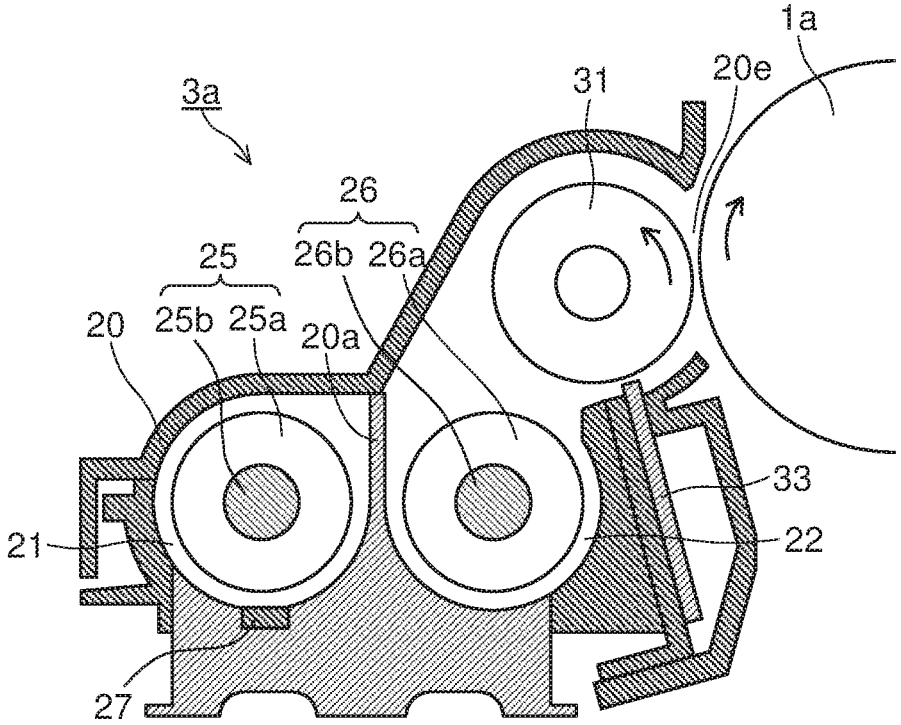
FIG. 2 is a side sectional view of the developing device of the embodiment.

FIG. 2 is a side sectional view of the developing device 3*a* according to this embodiment. The following description deals with, as an example, the developing device 3*a* arranged in the image forming portion Pa in FIG. 1. The developing devices 3*b* to 3*d* arranged in the image forming portions Pb to Pd have a structure basically similar to that of the developing device 3*a*, and thus no overlapping description will be repeated.

As shown in FIG. 2, the developing device 3*a* includes a developer container 20 that stores two-component developer (hereinafter also referred to simply as developer) containing magnetic carrier and toner. The developer container 20 is partitioned into a stirring/conveying chamber 21 and a feeding/conveying chamber 22 by a partition wall 20*a*. In the stirring/conveying chamber 21 and the feeding/conveying chamber 22, there are respectively rotatably arranged a stirring/conveying screw 25 and a feeding/conveying screw 26 which mix the toner fed from the toner container 4*a* (see FIG. 1) with magnetic carrier and which stir the toner and thereby electrostatically charge it.

Then, the developer is, while being stirred by the stirring/conveying screw 25 and the feeding/conveying screw 26, conveyed in the axial direction (the direction perpendicular to the plane of FIG. 2) and, via communication portions 20*b* and 20*c* (for either, see FIG. 3) formed in opposite end parts of the partition wall 20*a*, circulates between the stirring/conveying chamber 21 and the feeding/conveying chamber 22. Thus, the stirring/conveying chamber 21, the feeding/conveying chamber 22, and the communication portions 20*b* and 20*c* form a circulation passage for developer inside the developer container 20.

The developer container 20 extends obliquely to the upper right in FIG. 2. To the upper right of the feeding/conveying screw 26 in the developer container 20, a developing roller 31 is arranged. Part of an outer circumferential face of the developing roller 31 is exposed through an opening 20*e* in the developer container 20 so as to face the photosensitive drum 1*a*. The developing roller 31 rotates counter-clockwise in FIG. 2. The stirring/conveying screw 25, the feeding/conveying screw 26, and the developing roller 31 rotate at a predetermined rotation speed with the driving force from the main motor 40 (see FIG. 4).

The developing roller 31 is composed of a cylindrical developing sleeve which rotates counter-clockwise in FIG. 2 and a magnet (unillustrated) which is fixed inside the developing sleeve and which has a plurality of magnetic poles. Although a developing sleeve with a knurled surface is used here, any other developing sleeves can instead be used such as one with a number of recesses (dimples) formed on the surface, one with a blasted surface, or even one subjected to, in addition to knurling and recess formation, blasting or plating.

To the developer container 20, a regulating blade 33 is fixed along the longitudinal direction of the developing roller 31 (in the direction perpendicular to the plane of FIG. 2). A small gap is formed between a tip end portion of the regulating blade 33 and the surface of the developing roller 31.

Figure 4:
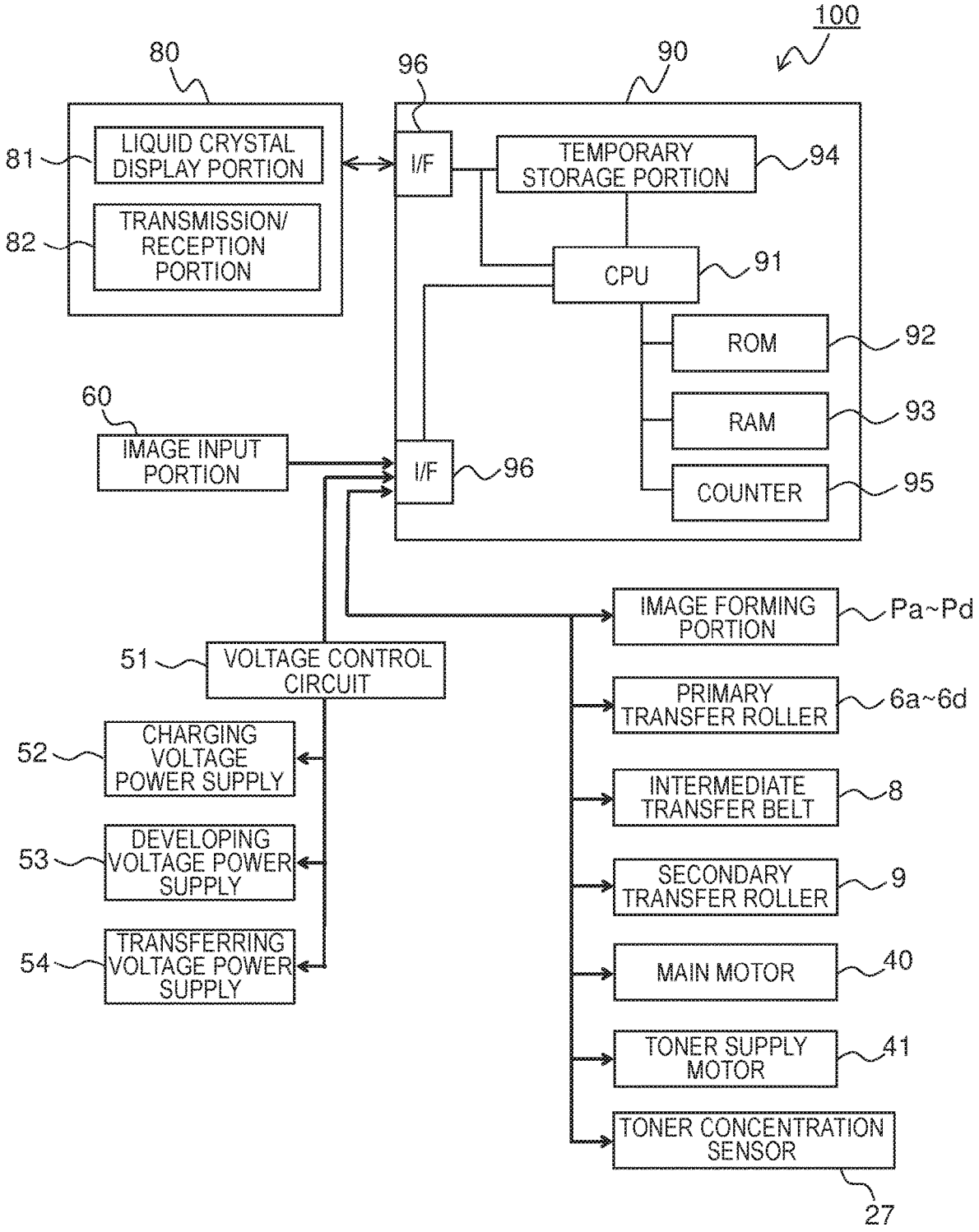
FIG. 4 is a block diagram showing one example of control paths used in the image forming apparatus.

To the developing device 3*a*, a developing voltage power supply 53 is connected via a voltage control circuit 51 (for either, see FIG. 4). The developing voltage power supply 53 applies a developing voltage produced by superimposing an alternating-current voltage on a direct-current voltage to the developing roller 31. With the developing voltage and the magnetic force of the magnet in the developing roller 31, developer is attached to (carried on) the surface of the developing roller 31 and a magnetic brush is formed.

In the stirring/conveying chamber 21, a toner concentration sensor 27 is arranged so as to face the stirring/conveying screw 25. The toner concentration sensor 27 senses the magnetic permeability of the developer in the developer container 20 and senses the concentration of toner in the developer (the mixture ratio of toner to carrier in the developer; T/C). A control portion 90 transmits to a toner supply motor 41 (for either, see FIG. 4) a control signal to supply toner to the developer container 20, in accordance with the toner concentration sensed by the toner concentration sensor 27, from the container 4*a* (see FIG. 1) via a toner feeding portion 35 (see FIG. 3) such that the toner concentration in the developer in the developer container 20 remains equal to the reference toner concentration.

Figure 3:
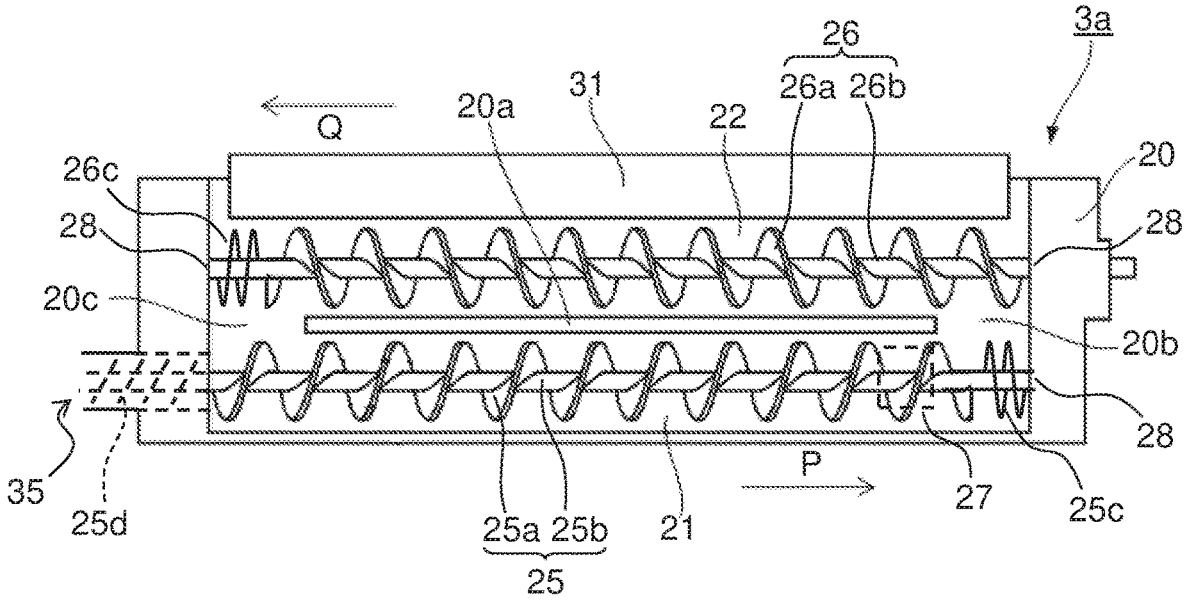
FIG. 3 is a sectional plan view showing a stirring portion of the developing device of the embodiment.

Next, the structure of a stirring portion of the developing device 3*a* will be described in detail. FIG. 3 is a sectional plan view showing a stirring portion of the developing device 3*a* of this embodiment. Formed in the developer container 20 are, as described above, the stirring/conveying chamber 21, the feeding/conveying chamber 22, the partition wall 20*a*, the upstream-side communication portion 20*b*, and the downstream-side communication portion 20*c*. Also formed there is the toner feeding portion 35. It is assumed that, with respect to the stirring/conveying chamber 21, the left side in FIG. 3 is the upstream side and the right side in FIG. 3 is the downstream side, and that, with respect to the feeding/conveying chamber 22, the right side in FIG. 3 is the upstream side, and the left side in FIG. 3 is the downstream side. Accordingly, the communication portions are referred to as the upstream-side one and the downstream-side one with respect to the feeding/conveying chamber 22.

The partition wall 20*a* extends in the longitudinal direction of the developer container 20 and partitions it into the stirring/conveying chamber 21 and the feeding/conveying chamber 22 such that these are located side by side. A right-side end part of the partition wall 20*a* in its longitudinal direction and the inner wall portion of the developer container 20 form the upstream-side communication portion 20*b*. A left-side end part of the partition wall 20*a* in its longitudinal direction and the inner wall portion of the developer container 20 form the downstream-side communication portion 20*c*.

The stirring/conveying screw 25 has a rotary shaft 25*b* as well as a helical blade 25*a* which is provided integrally with the rotary shaft 25*b* and which is formed in a helical shape with a predetermined pitch in the axial direction of the rotary shaft 25*b*. The helical blade 25*a* extends up to the opposite ends of the stirring/conveying chamber 21 in its longitudinal direction and is provided so as to face the upstream-side and downstream-side communication portions 20*b* and 20*c*.

The feeding/conveying screw 26 has a rotary shaft 26*b* as well as a helical blade 26*a* which is provided integrally with the rotary shaft 26*b* and which is formed in a helical shape with a blade winding in the direction opposite to (having the phase opposite to) the helical blade 25*a* with the same pitch as the helical blade 25*a* in the axial direction of the rotary shaft 26*b*. The helical blade 26*a* is longer than the developing roller 31 in the axial direction and is arranged so as to face the upstream-side and down-stream side communication portions 20*b* and 20*c*.

The rotary shafts 25*b* and 26*b* are arranged parallel to each other and are rotatably pivoted on bearing portions 28 provided at the opposite ends of the developer container 20 in the longitudinal direction. A seal member (unillustrated) for preventing developer from entering the developer container 20 is provided at the bearing portion 28. The bearing portion 28 (unillustrated) that supports an upstream-side end part (a left-side end part in FIG. 3) of the rotary shaft 25*b* is provided on the upstream side of the toner feeding portion 35.

In a downstream-side end part of the stirring/conveying screw 25 in the developer conveying direction (the arrow P direction) in the stirring/conveying chamber 21, a reverse conveying portion 25*c* is formed. Similarly, in a downstream-side end part of the feeding/conveying screw 26 in the developer conveying direction (the arrow Q direction) in the feeding/conveying chamber 22, a reverse conveying portion 26*c* is formed. The reverse conveying portions 25*c* and 26*c* are each configured as a helical blade winding in the direction opposite to (having the phase opposite to) the helical blade 25*a* or 26*a* respectively.

The reverse conveying portions 25*c* and 26*c*, by applying a reverse conveying force to the developer conveyed by the helical blades 25*a* and 26*a*, blocks and pushes back the developer. This prevents a rise in the rotation torque resulting from developer entering the bearing portions 28 of the rotary shaft 25*b* of the stirring/conveying screw 25 and the rotary shaft 26*b* of the feeding/conveying screw 26 as well as agglomeration of developer due to frictional heat. In addition, the developer stagnating around the downstream-side end part of the stirring/conveying chamber 21 due to the reverse conveying force from the reverse conveying portion 25*c* is discharged toward the upstream-side communication portion 20*b*. Similarly, the developer stagnating around the downstream-side end part of the feeding/conveying chamber 22 due to the reverse conveying force from the reverse conveying portion 26*c* is discharged toward the downstream-side communication portion 20*c*.

On the upstream side of the stirring/conveying chamber 21 (on the left side in FIG. 3), the toner feeding portion 35 is provided. The toner feeding portion 35 is connected to the toner container 4*a* (see FIG. 1) via a toner feeding passage (unillustrated) and feeds new toner stored in the toner container 4*a* into the developer container 20. The rotary shaft 25*b* of the stirring/conveying screw 25 extends into the toner feeding portion 35. A feeding blade 25*d*, which is formed in a helical shape with a predetermined pitch in the axial direction of the rotary shaft 25*b*, is integrally formed with a part of the rotary shaft 25*b* arranged inside the toner feeding portion 35.

Thus, developer is stirred while circulating from the stirring/conveying chamber 21 to the upstream-side communication portion 20*b*, then to the feeding/conveying chamber 22, and then to the downstream-side communication portion 20*c*. The stirred developer is fed to the developing roller 31. As toner is consumed through development, by the toner supply motor 41 (see FIG. 4), toner is fed into the stirring/conveying chamber 21 from the toner container 4*a* via the toner feeding portion 35.

Next, control paths in the image forming apparatus 100 will be explained. FIG. 4 is a block diagram showing one example of control paths used in the image forming apparatus 100. When the image forming apparatus 100 is used, different parts of the apparatus are controlled in different manners, and thus the control paths in the whole image forming apparatus 100 are complicated. Thus, the following description focuses on those control paths which are essential for implementation of the present disclosure.

The control portion 90 at least includes a CPU (central processing unit) 91, a ROM (read-only memory) 92 which is a read-only storage portion, a RAM (random-access memory) 93 which is a readable-writable storage portion, a temporary storage portion 94 which temporarily stores image data and the like, a counter 95, a plurality of (here, two) I/Fs (interfaces) 96 which transmit control signals to different devices in the image forming apparatus 100 and receives input signals from an operation portion 80. The control portion 90 can be arranged anywhere inside the main body of the image forming apparatus 100.

The ROM 92 stores data and the like that are not changed during the use of the image forming apparatus 100, such as control programs for the image forming apparatus 100 and numerical values needed for control. The RAM 93 stores necessary data generated during the control of the image forming apparatus 100, data temporarily needed to control the image forming apparatus 100, and the like. The counter 95 counts the number of printed sheets in a cumulative manner.

The control portion 90 transmits control signals to different parts and devices in the image forming apparatus 100 from the CPU 91 through the IF 96. From the different parts and devices, signals that indicate their status and input signals are transmitted through the IF 96 to the CPU 91. The different parts and devices controlled by the control portion 90 include, for example, the image forming portions Pa to Pd, the exposure device 5, the primary transfer rollers 6*a* to 6*d*, the secondary transfer roller 9, the main motor 40, the toner supply motor 41, a voltage control circuit 51, and the operation portion 80.

An image input portion 60 is a reception portion for receiving image data transmitted to the image forming apparatus 100 from a PC or the like. The image signal input via the image input portion 60 is converted to a digital signal and is then fed to a temporary storage portion 94.

The voltage control circuit 51 is connected to a charging voltage power supply 52, a developing voltage power supply 53, and a transferring voltage power supply 54, and makes those power supplies operate according to output signals from the control portion 90. In response to control signals from the voltage control circuit 51, the charging voltage power supply 52, the developing voltage power supply 53, and the transferring voltage power supply 54 apply predetermined voltages respectively to the charging devices 2*a* to 2*d*, to the developing roller 31 in the developing devices 3*a* to 3*d*, and to the primary transfer rollers 6*a* to 6*d* and the secondary transfer roller 9.

The operation portion 80 includes a liquid crystal display portion 81 and a transmission/reception portion 82. The liquid crystal display portion 81 indicates the status of the image forming apparatus 100 and displays the progress of image formation and the number of copies printed. Various settings for the image forming apparatus 100 are made via a printer driver on a personal computer. The transmission/reception portion 82 communicates with the outside using a telephone line or the Internet line.

Figure 5:
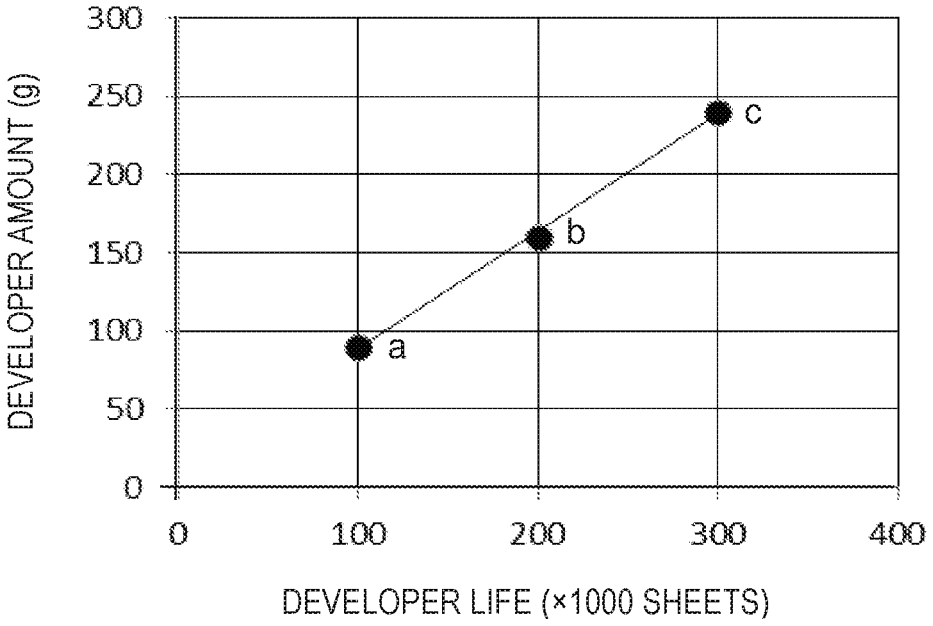
FIG. 5 is a graph showing a relationship of the unit life of the developing devices in the image forming apparatus with the loaded amount of developer in the developing devices.

FIG. 5 is a graph showing a relationship of the unit life of the developing devices 3*a* to 3*d* in the image forming apparatus 100 with the loaded amount of developer in the developing devices 3*a* to 3*d*. As shown in FIG. 5, when the printing speed of the image forming apparatus 100 is 20 sheets per minute (plot a), printing of a hundred thousand sheets is possible with a loaded amount of toner of 90 g. When the printing speed is 30 sheets per minute (plot b), printing of two hundred thousand sheets is possible with a loaded amount of toner of 150 g. When the printing speed is 40 sheets per minute (plot c), printing of three hundred thousand sheets is possible with a loaded amount of toner of 250 g. In this way, the higher the printing speed, the longer the unit life of the developing devices 3*a* to 3*d*. Thus, it is necessary to increase the loaded amount of developer in the developing devices 3*a* to 3*d* with increasing printing speed.

However, preparing a plurality of types of developer containers 20 with different developer capacities in accordance with the printing speed of the image forming apparatus 100 requires fabricating a plurality of types of stirring/conveying screws 25, feeding/conveying screws 26, developing rollers 31, and the like that suit different developer container 20, and this leads to an increased number of components. Also required then are modifications in the layout inside the image forming apparatus 100 and the like to accommodate changes in the outer dimensions of the developing devices 3*a* to 3*d*.

Thus, in this embodiment, as the stirring/conveying screws 25 and the feeding/conveying screws 26 fitted to the developing devices 3*a* to 3*d*, a plurality of types of stirring/conveying screws 25 and feeding/conveying screws 26 with rotary shafts 25*b* and 26*b* with different shaft diameters are prepared in advance, and the optimum stirring/conveying screw 25 and feeding/conveying screw 26 are selected according to the printing speed of the image forming apparatus 100 mounted with the developing devices 3*a* to 3*d*.

Figure 6:
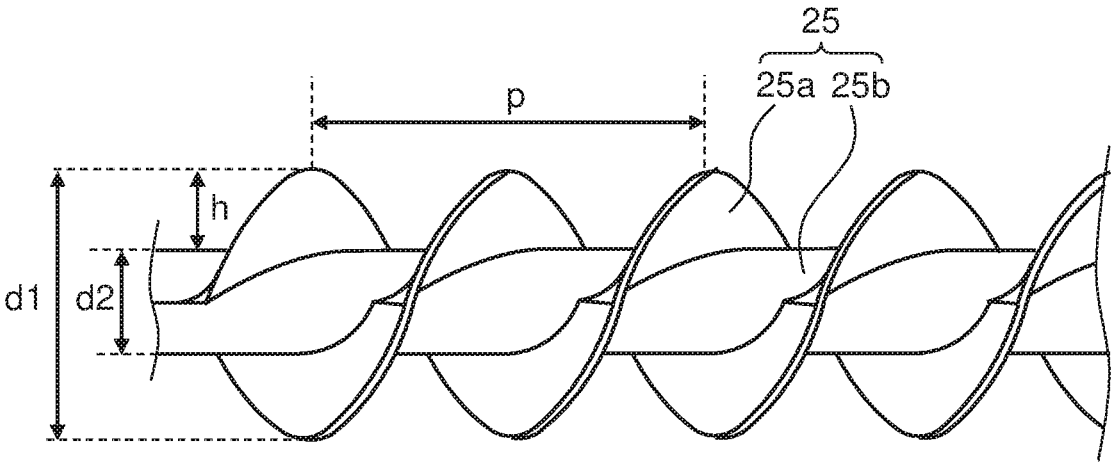
FIG. 6 is a partial side view of, out of stirring/conveying screws usable in the developing devices of this embodiment, one with a rotary shaft with a small shaft diameter.

FIG. 6 is a partial side view of, out of stirring/conveying screws 25 usable in the developing devices 3*a* to 3*d* of this embodiment, one with a rotary shaft 25*b* with a small shaft diameter. The stirring/conveying screw 25 shown in FIG. 6 has an outer diameter (the diameter of the helical blade 25*a*) d1 of 20 mm, a shaft diameter d2 of 8 mm across the rotary shaft 25*b*, a blade height h of 6 mm, and a pitch p of 30 mm, and the number of threads (the number of ridges) of the helical blade 25*a* is two.

Figure 7:
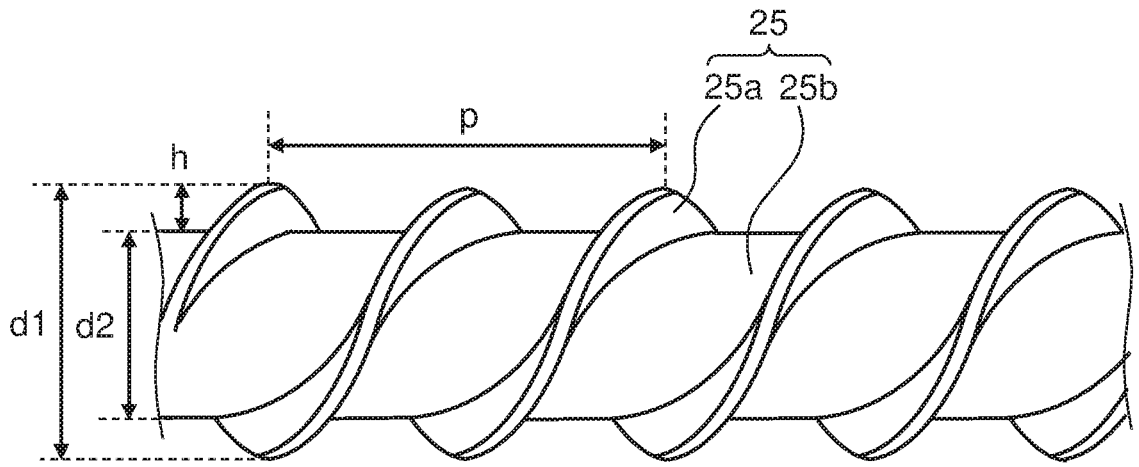
FIG. 7 is a partial side view of, out of stirring/conveying screws usable in the developing devices of this embodiment, one with a rotary shaft with a large shaft diameter.

FIG. 7 is a partial side view of, out of stirring/conveying screws 25 usable in the developing devices 3*a* to 3*d* of this embodiment, one with a rotary shaft 25*b* with a large shaft diameter. The stirring/conveying screw 25 shown in FIG. 7 has an outer diameter (the diameter of the helical blade 25*a*) d1 of 20 mm, a shaft diameter d2 of 14 mm across the rotary shaft 25*b*, a blade height h of 3 mm, and a pitch p of 30 mm, and the number of threads of the helical blade 25*a* is two.

The stirring/conveying screws 25 shown in FIGS. 6 and 7 are different in the shaft diameter d2 across the rotary shaft 25*b* (and the blade height h that changes with the shaft diameter); they are the same otherwise, that is, in the outer diameter d1, the pitch p, and the number of threads. The outer diameter d1 is adjusted such that, when the stirring/conveying screw 25 is arranged in the stirring/conveying chamber 21 in the developer container 20, the gap between the outer circumferential edge of the helical blade 25*a* and the inner wall face of the stirring/conveying chamber 21 equals 1.5 mm. Although not illustrated here, also for the feeding/conveying screw 26 arranged in the feeding/conveying chamber 22, two types are prepared which have the same configuration as the stirring/conveying screws 25 shown in FIGS. 6 and 7.

Figure 8:
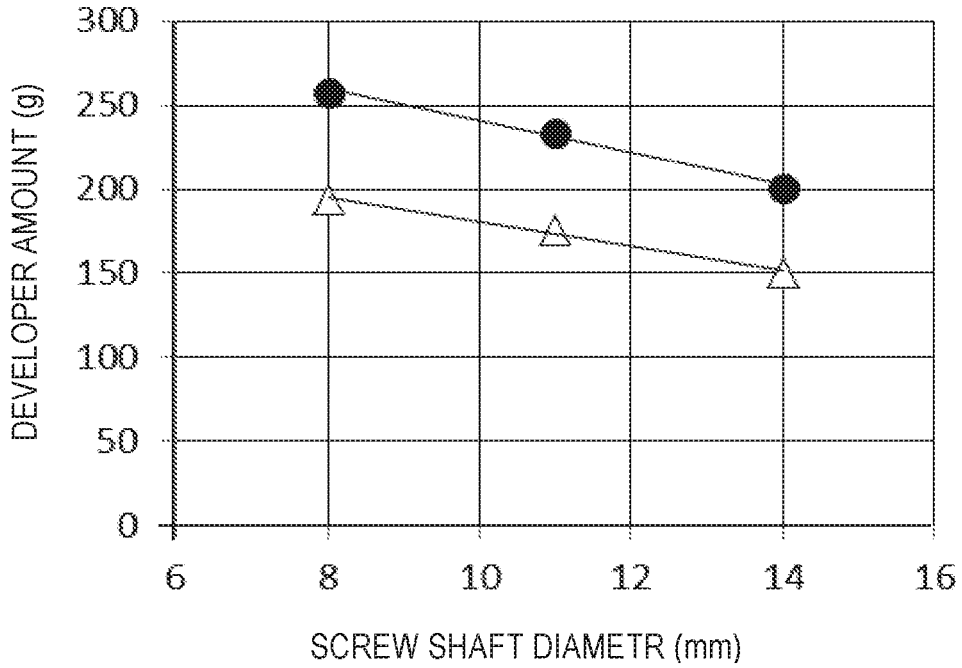
FIG. 8 is a graph showing a relationship of the shaft diameter of the rotary shafts of the stirring/conveying screw and the feeding/conveying screw with the amount of developer loaded in the developer container as observed when the proportion of the developer loaded in the developer container is 60% and 80%.
Figure 9:
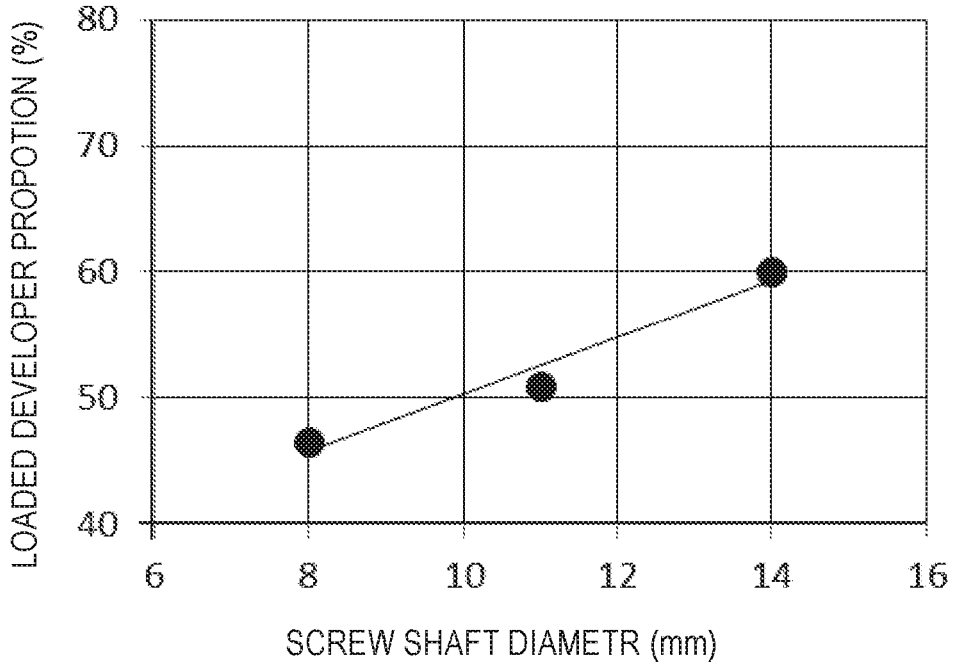
FIG. 9 is a graph showing a relationship of the shaft diameter of the rotary shafts of the stirring/conveying screw and the feeding/conveying screw with the proportion of the developer loaded in the developer container as observed when the amount of developer loaded in the developer container is 150 g.

FIG. 8 is a graph showing a relationship of the shaft diameter of the rotary shafts 25*b* and 26*b* of the stirring/conveying screw 25 and the feeding/conveying screw 26 with the amount of developer loaded in the developer container 20 as observed when the proportion of the developer loaded in the developer container 20 is 60% and 80%. FIG. 9 is a graph showing a relationship of the axial diameter of the rotary shafts 25*b* and 26*b* of the stirring/conveying screw 25 and the feeding/conveying screw 26 with the proportion of the developer loaded in the developer container 20 as observed when the amount of developer loaded in the developer container 20 is 150 g.

The proportion of the loaded developer can be given by the following formula (1).

$$\text{Loaded Developer Proportion (\%)} = \text{Loaded Developer Amount (g)} / \{(\text{Developer Container Capacity} - \text{Screw Volume})\ (\text{cm}^3) - \text{Developer Density}\ (\text{g/cm}^3)\} \times 100 \quad (1)$$

As shown in FIG. 8, with both a loaded proportion of 60% (the series of data indicated by hollow triangles in FIG. 8) and a loaded proportion of 80% (the series of data indicated by solid circles in FIG. 8), there is a correlation between the shaft diameters of the rotary shafts 25*b* and 26*b* of the stirring/conveying screw 25 and the feeding/conveying screw 26, and the loaded developer amount. The larger the shaft diameters of the rotary shafts 25*b* and 26*b*, the smaller the loaded developer amount needed to obtain loading ratios of 60% and 80%. This is because, the larger the shaft diameter of the rotary shafts 25*b* and 26*b*, due to an increase in the screw volume in formula (1) above, the smaller the denominator on the right side, and thus the smaller the loaded developer amount needed to obtain a predetermined developer loading ratio.

As shown in FIG. 9, when the loaded developer amount in the developer container 20 is constant (150 g), the larger the shaft diameter of the rotary shafts 25*b* and 26*b*, the higher the loaded developer proportion. This is because, the larger the shaft diameter of the rotary shafts 25*b* and 26*b*, due to an increase in the screw volume in formula (1) above, the smaller the denominator on the right side, and thus the higher the loaded developer proportion so long as the loaded developer amount is constant.

To ensure satisfactory mixing performance (stirring property) for developer and replenishment toner in the developer container 20, it is necessary to set the loaded proportion within the range of 60 to 80%. According to FIG. 9, when the loaded amount of developer is 150 g, by changing the shaft diameters across the rotary shafts 25*b* and 26*b* of the stirring/conveying screw 25 and the feeding/conveying screw 26 from 8 mm to 14 mm, it is possible to obtain a loading ratio of 60%.

In addition, as shown in FIG. 5, the image forming apparatus 100 with a printing speed of 30 sheets per minute can print two hundred thousand sheets with a loaded amount of toner of 150 g and the image forming apparatus 100 with a printing speed of 40 sheets per minute can print three hundred thousand sheets with a loaded amount of toner of 250 g. Thus, it is possible to set the loaded proportion within the range of 60 to 80% by using, in the image forming apparatus 100 with a printing speed of 30 sheets per minute, the stirring/conveying screw 25 and the feeding/conveying screw 26 shown in FIG. 7 to set a loaded amount of toner at 150 g, and by using, in the image forming apparatus 100 with a printing speed of 40 sheets per minute, the stirring/conveying screw 25 and the feeding/conveying screw 26 shown in FIG. 6 to set a loaded amount of toner at 250 g. That is, identical developing devices 3*a* to 3*d* are usable in the image forming apparatuses 100 with any printing speed between 40 sheets per minute to 30 sheets per minute.

Figure 10:
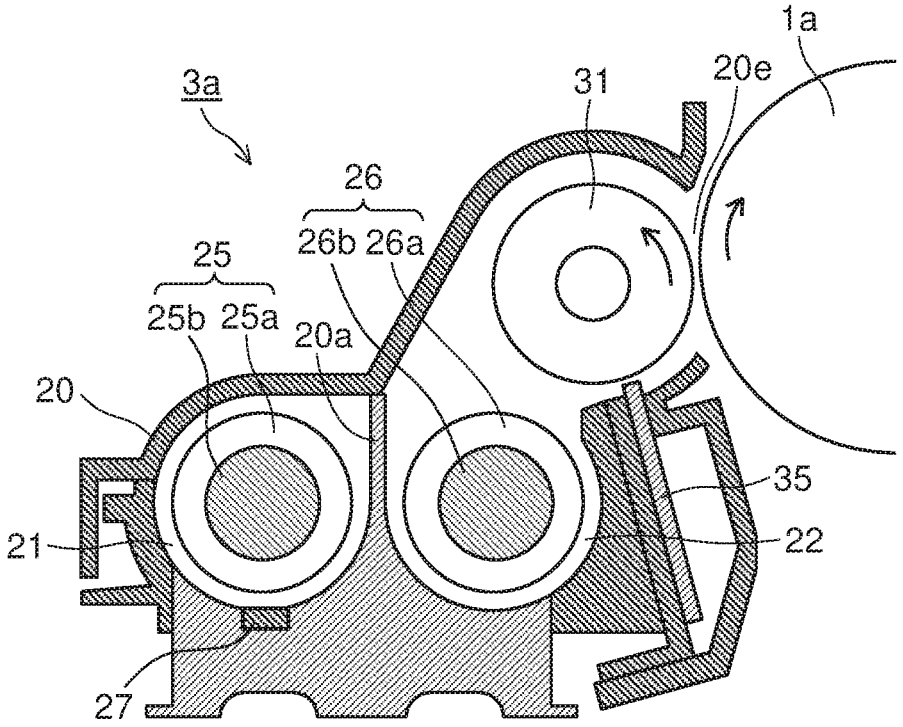
FIG. 10 is a side sectional view of the developing device fitted with the stirring/conveying screw and the feeding/conveying screw with large-diameter rotary shafts.

FIG. 10 is a side sectional view of the developing device 3*a* fitted with the stirring/conveying screw 25 and the feeding/conveying screw 26 with large-diameter rotary shafts 25*b* and 26*b* as shown in FIG. 7. In other respects, the configuration of the developing device 3*a* is similar to that in FIGS. 2 and 3. By mounting the developing devices 3*a* to 3*d* shown in FIG. 10 on an image forming apparatus 100 with a low printing speed, it is possible to reduce the loaded amount of developer without lowering the loaded developer proportion (the volume of developer) in the developer container 20.

In this way, it is possible to reduce the loaded developer amount in accordance with the toner consumption speed in the developing devices 3*a* to 3*d* and thus it is no longer necessary to load unnecessary toner; thus it is possible to consume developer efficiently without degrading it. Also, with no decline in the loaded developer proportion, it is possible to prevent uneven toner conveyance due to failure in scooping up developer to the developing roller 31, and thus to obtain satisfactory images over a long period of time.

Furthermore, simply by selecting a stirring/conveying screw 25 and a feeding/conveying screw 26, it is possible to easily manufacture, with the same shape, developing devices 3*a* to 3*d* that suit varying printing speed of the image forming apparatus 100. This helps suppress an increase in the number of components and eliminates the need to modify the layout inside the image forming apparatus 100 and the like.

Figure 11:
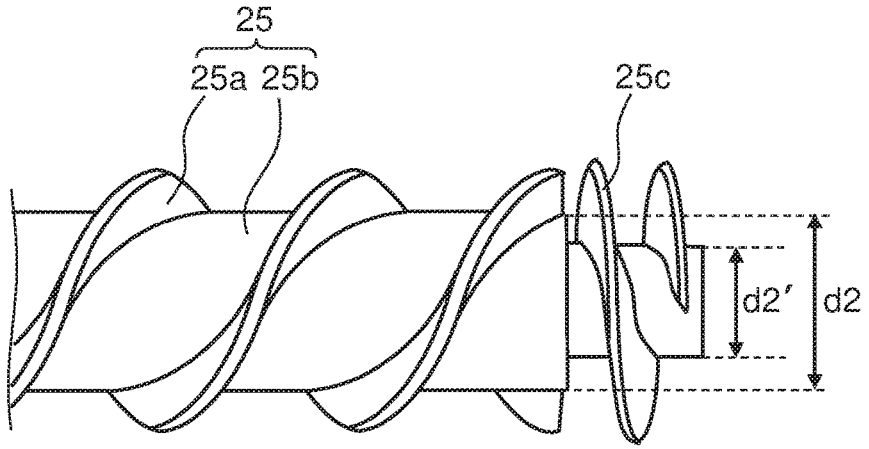
FIG. 11 is a partial side view of and around a reverse conveying portion of the stirring/conveying screw with a large-diameter rotary shaft.

FIG. 11 is a partial side view of and around the reverse conveying portion 25*c* of the stirring/conveying screw 25 with a large-diameter rotary shaft 25*b*. As shown in FIG. 11, the shaft diameter d2' across the rotary shaft 25*b* in a downstream-side end part where the reverse conveying portion 25*c* is formed is smaller than the shaft diameter d2 (14 mm) in the other part. More specifically, the shaft diameter d2' is equal to the shaft diameter (8 mm) across the rotary shaft 25*b* of the stirring/conveying screw 25 with a small-diameter rotary shaft 25*b* (see FIG. 6).

In this way, it is possible to give the bearing portion 28 (see FIG. 3) a common structure between the stirring/conveying screws 25 with the small-diameter rotary shaft 25*b* and with the large-diameter rotary shaft 25*b*. Also for the seal member that prevents developer from entering the bearing portion 28, an identically designed one can be used.

The larger the shaft diameter across the rotary shaft 25*b*, the smaller the height of the helical blade that forms the reverse conveying portion 25*c*, and thus the smaller the reverse conveying force. This results in a lower effect of blocking and pushing back developer by the reverse conveying portion 25*c*. With the configuration according to FIG. 11, it is possible to secure a satisfactory reverse conveying force by the reverse conveying portion 25*c* and to effectively prevent developer from entering the bearing portion 28. Although FIG. 11 illustrates the structure of and around the reverse conveying portion 25*c* of the stirring/conveying screw 25, the same applies to the structure of and around the reverse conveying portion 26*c* in the feeding/conveying screw 26.

The above embodiments deal with an example where, when the printing speed is low, a stirring/conveying screw 25 and a feeding/conveying screw 26 with rotary shafts 25*b* and 26*b* with a large shaft diameter (see FIGS. 7 and 11) are selected, and when the printing speed is high, a stirring/conveying screw 25 and a feeding/conveying screw 26 with rotary shafts 25*b* and 26*b* with a small shaft diameter (see FIG. 6) are selected. This, however, is not meant to limit the present disclosure.

For example, in the image forming apparatus 100 shown in FIG. 1, the developing devices 3*a* to 3*d* are mounted in the image forming portions Pa to Pd corresponding to images of four different colors (cyan, magenta, yellow, and black) respectively. However, the toner consumption amount differs from color to color. Specifically, black toner, which is used even in monochrome printing, is consumed the most, and toner of the other three colors is consumed less. For black, for which toner is consumed in large quantities, with consideration given to the life of developer, a large amount of developer is required.

To cope with that, only the developing device 3*d* mounted on the image forming portion Pd that corresponds to the black image is given a configuration as shown in FIG. 2 where the stirring/conveying screw 25 and the feeding/conveying screw 26 with the small-diameter rotary shafts 25*b* and 26*b* are selected. On the other hand, the developing devices 3*a* to 3*c* mounted on the image forming portions Pa to Pc that correspond to the images of the other three colors are given a configuration as shown in FIG. 10 where the stirring/conveying screw 25 and the feeding/conveying screw 26 with the large-diameter rotary shafts 25*b* and 26*b* are selected. In this way, it is possible to increase the loaded developer amount in the developing device 3*d* for black, for which toner is consumed in large quantities, and to decrease the loaded developer amount in the developing devices 3*a* to 3*c* for cyan, magenta, and yellow, for which toner is consumed in small quantities, thereby to suppress degradation of developer.

Incidentally, changing the shaft diameters of the rotary shafts 25*b* and 26*b* of the stirring/conveying screw 25 and the feeding/conveying screw 26 results in changing how developer is stirred and conveyed, and this causes the output value of the toner concentration sensor 27 to change. This usually makes it necessary to change, or perform correction control for, the toner concentration sensor 27.

Thus, it is preferable to arrange the toner concentration sensor 27 at a place where, even when the shaft diameters of the rotary shafts 25*b* and 26*b* are changed, the change in the output value of the toner concentration sensor 27 is small. To determine the optimum arrangement of the toner concentration sensor 27, experiments were performed where the toner concentration sensors 27 was arranged in one of regions A to C in the stirring/conveying chamber 21 in the developer container 20 shown in FIG. 12 and, as the toner concentration (T/C) in developer was changed, the change in the sensor output value was measured.

Region A is a region on the downstream side of the stirring/conveying chamber 21 in the developer conveying direction (the arrow P direction), and it is where developer passes immediately before being conveyed from the stirring/conveying chamber 21 to the feeding/conveying chamber 22. Region C is a region on the upstream side of the stirring/conveying chamber 21 in the developer conveying direction, and it is where developer passes immediately after being conveyed from the stirring/conveying chamber 21 to the feeding/conveying chamber 22. Region B is a middle part of the stirring/conveying chamber 21 located between Regions A and C.

Figure 12:
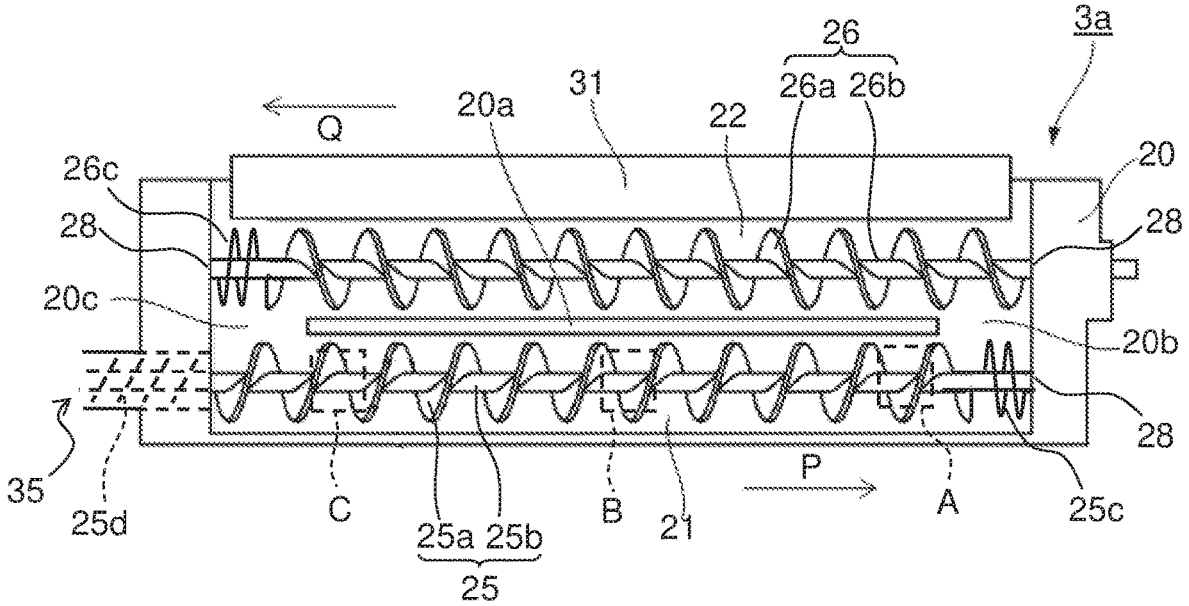
FIG. 12 is a sectional plan view showing the stirring portion of the developing device of the embodiment, illustrating regions A to C for studying the relationship of toner concentration with the sensor output value depending on the arrangement of a toner concentration sensor.
Figure 13:
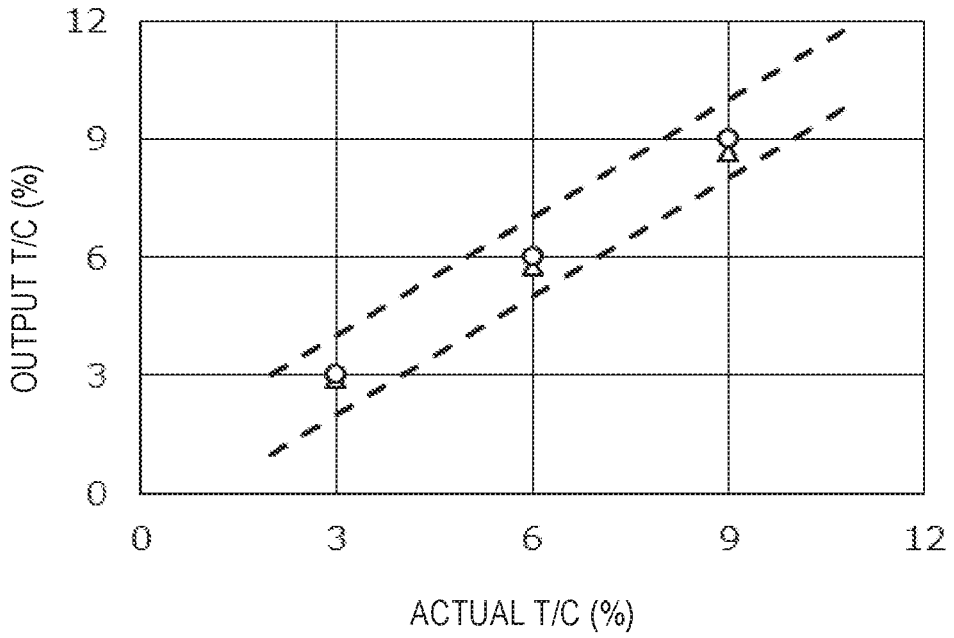
FIG. 13 is a graph showing a relationship of the toner concentration with the sensor output value as observed when the toner concentration sensor is arranged in region A in FIG. 12.
Figure 14:
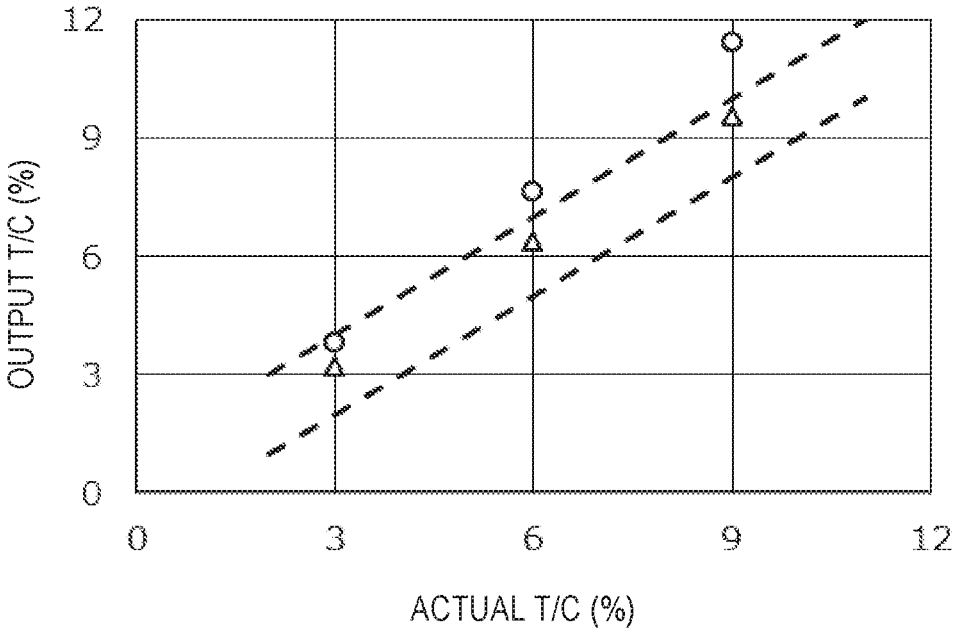
FIG. 14 is a graph showing a relationship of the toner concentration with the sensor output value as observed when the toner concentration sensor is arranged in region B in FIG. 12.
Figure 15:
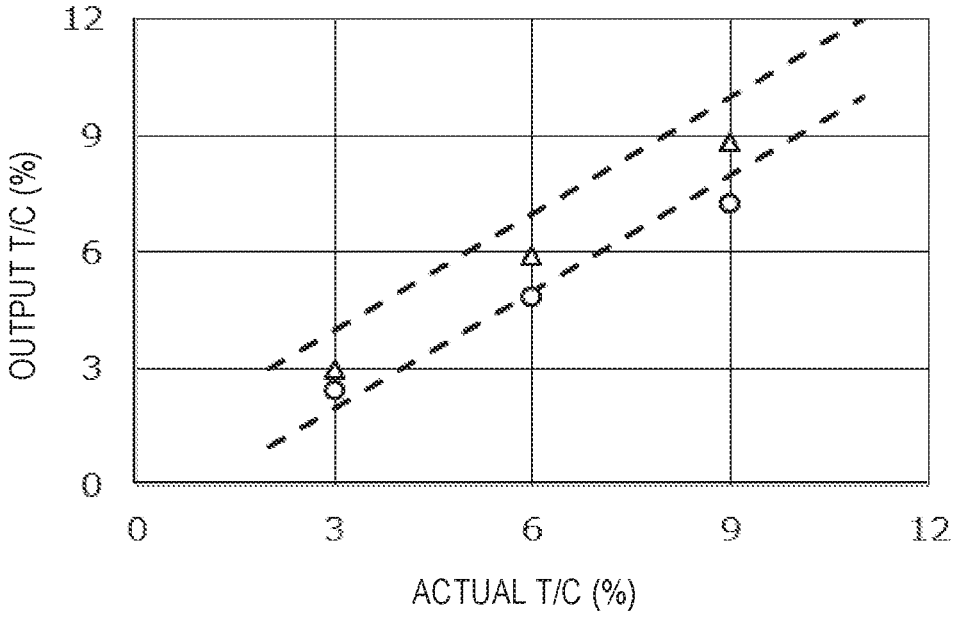
FIG. 15 is a graph showing a relationship of the toner concentration with the sensor output value as observed when the toner concentration sensor is arranged in region C in FIG. 12.

FIGS. 13 to 15 are graphs showing the relationship of the toner concentration with the sensor output value as observed when the toner concentration sensor 27 was arranged in regions A to C, respectively, in FIG. 12. When the toner concentration sensor 27 was arranged in region A, as shown in FIG. 13, in either of the cases where the shaft diameter across the rotary shafts 25*b* and 26*b* was 8 mm (the series of data indicated by hollow triangles) and 14 mm (the series of data indicated by hollow circles), the actual toner concentration (actual T/C) and the sensor output value (output T/C) matched well. This is considered to be because region A, which is on the downstream side of the stirring/conveying chamber 21 in the developer conveying direction, is farthest from the toner feeding portion 35 and thus, before replenishment toner reached the toner concentration sensor 27, it was stirred and mixed sufficiently with the developer in the developer container 20.

On the other hand, when the toner concentration sensor 27 was arranged in region B or C, as shown in FIGS. 14 and 15, in the case where the shaft diameter across the rotary shafts 25*b* and 26*b* was 14 mm (the series of data indicated by hollow circles), there were deviations between the actual toner concentration and the sensor output value. This is considered to be because region B, which is at the middle of the stirring/conveying chamber 21, and region C, which is on the upstream side of the stirring/conveying chamber 21 in the developer conveying direction, are near the toner feeding portion 35 and thus, especially when the stirring/conveying screw 25 and the feeding/conveying screw 26 with rotary shafts 25*b* and 26*b* with a large diameter of 14 mm and thus having low stirring performance were used, replenishment toner was not sufficiently stirred and mixed with the developer in the developer container 20.

From the above results, it has been confirmed that arranging the toner concentration sensor 27 in region A on the downstream side of the stirring/conveying chamber 21 in the developer conveying direction (the arrow P direction) helps stabilize the sensor output value and helps sense the toner concentration in developer accurately.

The embodiment described above is in no way meant to limit the present disclosure, which thus allows for many modifications and variations within the spirit of the present disclosure. For example, the above embodiments deal with an example where two types of stirring/conveying screws 25 and of feeding/conveying screws 26 with rotary shafts 25*b* and 26*b* with different shaft diameters are selectively used. However, by selectively using more than three types of stirring/conveying screws 25 and of feeding/conveying screws 26 with rotary shafts 25*b* and 26*b* with different shaft diameters, it is possible to adjust the loaded developer amount more appropriately in accordance with the printing speed and the life of developer.

For another example, although the above embodiments deal with the developing devices 3*a* to 3*d* of a two-component developing type, this is not meant as any limitation to developing devices of a two-component developing type. For example, the present disclosure is also applicable similarly to developing devices of a one-component developing type that use magnetic one-component developer containing magnetic toner alone.

For yet another example, although the above embodiments deal with the developing devices 3*a* to 3*d* including the developer container 20 in which the stirring/conveying chamber 21 and the feeding/conveying chamber 22 are arranged parallel to each other across the partition wall 20*a*, this is not meant to limit the present disclosure. The present disclosure is also applicable similarly to developing devices that have one, or three or more, conveying chambers in which a stirring/conveying member is arranged, such as a developing device that has a feeding/conveying chamber arranged above a stirring/conveying chamber across a partition wall, or a developing device that has, in addition to a stirring/conveying chamber and a feeding/conveying chamber, a collection/conveying chamber for collecting developer removed from the developing roller 31.

The present disclosure is applicable not only to tandem-type color printers such as the one shown in FIG. 1 but also to various types of image forming apparatuses of a two-component development type such as digital and analogue monochrome copiers, monochrome printers, color copiers, and facsimile machines.

The present disclosure is applicable to developing devices including a stirring/conveying member which conveys developer while stirring it. Based on the present disclosure, it is possible to provide a developing device that can optimize the loaded developer amount in accordance with the printing speed and the life of developer without lowering the loaded developer proportion, as well as to provide an image forming apparatus incorporating such a developing device.

What is claimed is:

1. A developing device composing:

a developer container which stores developer containing toner;

a developer carrier which carries on a surface thereof the toner in the developer container;

a stirring/conveying member which includes a rotary shaft rotatably supported on the developer container and a stirring blade formed around an outer circumferential face of the rotary shaft and which stirs and conveys the developer in the developer container, wherein during manufacturing of the developing device, the stirring/conveying member to be used can be selected from a plurality of types of stirring/conveying members with rotary shafts with different shaft diameters, the developing device can be mounted in a plurality of image forming apparatuses with different printing speeds, and when the developing device is mounted on an image forming apparatus with a relatively low printing speed, compared to when the developing device is mounted on an image forming apparatus with a relatively high printing speed, the stirring/conveying member with the rotary shaft with a larger shaft diameter is selected.

2. The developing device according to claim 1, wherein the plurality of types of stirring conveying members have stirring blades with an equal outer diameter.

3. The developing device according to claim 1, wherein the stirring/conveying member includes, in a downstream-side end part in a developer conveying direction, a reverse conveying portion composed of a stirring blade which is winding in the direction opposite to the stirring blade which are formed around the outer circumferential face of the rotary shaft.

4. The developing device according to claim 3, wherein in the stirring/conveying member other than the stirring/conveying member with the rotary shaft with the smallest shaft diameter, the shaft diameter of the rotary shaft in a part thereof where the reverse conveying portion is formed is smaller than the shaft diameter of the rotary shaft in another part thereof.

5. The developing device according to claim 1, wherein the developer container includes a first conveying chamber, a second conveying chamber arranged parallel to the first conveying chamber across a partition portion, and a communication portion which allows the first conveying chamber and the second conveying chamber to communicate with each other in opposite end parts of the partition portion in a longitudinal direction, the stirring/conveying member includes a first stirring/conveying member which conveys, while stirring, the developer in the first conveying chamber, and a second stirring/conveying member which conveys, while stirring, the developer in the second conveying chamber in a direction opposite to a direction in which the first stirring/conveying member conveys the developer, and the developer carrier is arranged above the second stirring/conveying member.

6. The developing device according to claim 5, wherein the developer is a two-component developer containing the toner and magnetic carrier, the developing device includes a toner concentration sensor for sensing toner concentration in the two-component developer in the developer container, and the toner concentration sensor is arranged inside the first stirring/conveying chamber, in a downstream-side part thereof in the conveying direction of the developer.

7. An image forming apparatus comprising the developing device according to claim 1.

8. A developing device comprising:

a developer container which stores developer containing toner;

a developer carrier which carries on a surface thereof the toner in the developer container;

a stirring/conveying member which includes a rotary shaft rotatably supported on the developer container and a stirring blade formed around an outer circumferential face of the rotary shaft and which stirs and conveys the developer in the developer container, wherein during manufacturing of the developing device, the stirring/conveying member to be used can be selected from a plurality of types of stirring/conveying members with rotary shafts with different shaft diameters, the developing device can be mounted on a plurality of image forming apparatuses with different unit lives of the developing device, and when the developing device is mounted on an image forming apparatus with a relatively short unit life, compared to when the developing device is mounted on an image forming apparatus with a relatively long unit life, the stirring/conveying member with the rotary shaft with a larger shaft diameter is selected.

9. The developing device according to claim 8, wherein the plurality of types of stirring/conveying members have stirring blades with an equal outer diameter.

10. The developing device according to claim 8, wherein the stirring/conveying member includes, in a downstream-side end part in a developer conveying direction, a reverse conveying portion composed of a stirring blade which is winding in the direction opposite to the stirring blade which are formed around the outer circumferential face of the rotary shaft.

11. The developing device according to claim 10, wherein in the stirring/conveying member other than the stirring/conveying member with the rotary shaft with the smallest shaft diameter, the shaft diameter of the rotary shaft in a part thereof where the reverse conveying portion is formed is smaller than the shaft diameter of the rotary shaft in another part thereof.

12. The developing device according to claim 8, wherein the developer container includes a first conveying chamber, a second conveying chamber arranged parallel to the first conveying chamber across a partition portion, and a communication portion which allows the first conveying chamber and the second conveying chamber to communicate with each other in opposite end parts of the partition portion in a longitudinal direction, the stirring/conveying member includes a first stirring/conveying member which conveys, while stirring, the developer in the first conveying chamber, and a second stirring/conveying member which conveys, while stirring, the developer in the second conveying chamber in a direction opposite to a direction in which the first stirring/conveying member conveys the developer, and the developer carrier is arranged above the second stirring/conveying member.

13. The developing device according to claim 12, wherein the developer is a two-component developer containing the toner and magnetic carrier, the developing device includes a toner concentration sensor for sensing toner concentration in the two-component developer in the developer container, and the toner concentration sensor is arranged inside the first stirring/conveying chamber, in a downstream-side part thereof in the conveying direction of the developer.

14. An image forming apparatus comprising the developing device according to claim 8.

15. A developing device comprising:

a developer container which stores developer containing toner;

a developer carrier which carries on a surface thereof the toner in the developer container;

a stirring/conveying member which includes a rotary shaft rotatably supported on the developer container and a stirring blade formed around an outer circumferential face of the rotary shaft and which stirs and conveys the developer in the developer container, wherein during manufacturing of the developing device, the stirring/conveying member to be used can be selected from a plurality of types of stirring/conveying members with rotary shafts with different shaft diameters, the developing device can be mounted on each of a plurality of image forming portions in an image forming apparatus including a plurality of image forming portions corresponding to images of a plurality of different colors, and when the developing device is mounted on the image forming portion that consumes a relatively small quantity of toner, compared to when the developing device is mounted on an image forming portion that consumes a relatively large quantity of toner, the stirring/conveying member with the rotary shaft with a larger shaft diameter is selected.

16. The developing device according to claim 15, wherein the developing device can be mounted on each of four image forming portions corresponding to images of four colors which are cyan, magenta, yellow, and black, and when the developing device is mounted on the image forming portion corresponding to a black image, compared to when the developing device is mounted on the image forming portion corresponding to images of colors other than black, the stirring/conveying member with the rotary shaft with a smaller shaft diameter is selected.

17. The developing device according to claim 15, wherein the plurality of types of stirring/conveying members have stirring blades with an equal outer diameter.

18. The developing device according to claim 15, wherein the stirring/conveying member includes, in a downstream-side end part in a developer conveying direction, a reverse conveying portion composed of a stirring blade which is winding in the direction opposite to the stirring blade which are formed around the outer circumferential face of the rotary shaft.

19. The developing device according to claim 18, wherein in the stirring/conveying member other than the stirring/conveying member with the rotary shaft with the smallest shaft diameter, the shaft diameter of the rotary shaft in a part thereof where the reverse conveying portion is formed is smaller than the shaft diameter of the rotary shaft in another part thereof.

20. The developing device according to claim 15, wherein the developer container includes a first conveying chamber, a second conveying chamber arranged parallel to the first conveying chamber across a partition portion, and a communication portion which allows the first conveying chamber and the second conveying chamber to communicate with each other in opposite end parts of the partition portion in a longitudinal direction, the stirring/conveying member includes a first stirring/conveying member which conveys, while stirring, the developer in the first conveying chamber, and a second stirring/conveying member which conveys, while stirring, the developer in the second conveying chamber in a direction opposite to a direction in which the first stirring/conveying member conveys the developer, and the developer carrier is arranged above the second stirring/conveying member.

21. The developing device according to claim 20, wherein the developer is a two-component developer containing the toner and magnetic carrier, the developing device includes a toner concentration sensor for sensing toner concentration in the two-component developer in the developer container, and the toner concentration sensor is arranged inside the first stirring/conveying chamber, in a downstream-side part thereof in the conveying direction of the developer.

22. An image forming apparatus comprising the developing device according to claim 15.

* * * * *